United States Patent [19]

Vignon

[11] 4,437,300

[45] Mar. 20, 1984

[54] DEVICE FOR THE CONTINUOUS SPINNING OF TEXTILE YARNS

[75] Inventor: Louis Vignon, Geneva, Switzerland

[73] Assignee: Heberlein Hispano SA, Vernier-Geneve, Switzerland

[21] Appl. No.: 324,943

[22] Filed: Nov. 24, 1981

[30] Foreign Application Priority Data

Dec. 8, 1980 [DE] Fed. Rep. of Germany ..... 3046180
Dec. 12, 1980 [DE] Fed. Rep. of Germany ..... 3046932
Dec. 16, 1980 [DE] Fed. Rep. of Germany ..... 3047275

[51] Int. Cl.[3] ..... D01H 1/06; D01H 1/20; D01H 7/66

[52] U.S. Cl. ..... 57/74; 57/67; 57/92

[58] Field of Search ..... 57/67, 70, 71, 74, 68, 57/72, 92, 93, 102, 103

[56] References Cited

U.S. PATENT DOCUMENTS

| | | | |
|---|---|---|---|
| 1,618,519 | 2/1927 | Roysancour | 57/74 X |
| 2,449,431 | 9/1948 | Weiss | 57/71 |
| 2,483,276 | 9/1949 | Ham | 57/70 |
| 2,603,059 | 7/1952 | Vokurka | 57/70 |
| 2,833,111 | 5/1958 | Hadlich | 57/74 |
| 3,117,409 | 1/1964 | Shino | 57/67 |

*Primary Examiner*—John Petrakes
*Attorney, Agent, or Firm*—Young & Thompson

[57] ABSTRACT

The device is composed of a spindle (7) which is provided with a drive means (9 and 10), and of a member for providing a twist, in the form of a bell (1), which encloses the spindle and can be rotated about the extended spindle axis. The bell is mounted independently of the spindle and provided with a drive means (5 and 6), which is furnished with a built-in freewheel (4) to enable the bell to rotate more rapidly than its drive means.

10 Claims, 7 Drawing Figures

DEVICE FOR THE CONTINUOUS SPINNING OF TEXTILE YARNS

The invention relates to a device for the continuous spinning of textile yarns.

So-called bell spinning frames have been known for a long time. They work on the same principle as ring spinning frames and differ from the latter merely in the method of thread guidance. In bell spinning frames this is effected by the friction of the yarn, which is fed in from a drawing frame outside the bell against the bottom edge of the bell on the inside of which the rotating spindle with the yarn body is located.

The disadvantage of such bell spinning frames is that the yarn balloon which forms between the thread guide above the bell and the bottom edge of the bell becomes uncontrollable at higher spindle speeds, so that it is only possible to work at relatively low speeds.

It has been shown that if yarn can be fed into the bell from the drawing frame via an aperture located in the extended spindle axis, the formation of a balloon can be avoided. However, to date a satisfactory spinning device of this type which can work at relatively high spindle rotation speeds e.g. 20,000–25,000 revs/min. and more, has not been produced.

The present invention consists in a device for continuous spinning of textile yarn, including a spindle having drive means and a member for providing a twist in the yarn surrounding the spindle and being mounted independently of the spindle for rotation about the spindle axis, the member having drive means and one of the spindle or member having an element which can rotate more rapidly than the drive means of the respective spindle or member.

The element may be a freewheel disposed to allow the member to rotate more rapidly that its drive means or alternatively it may be a freewheel disposed to allow the spindle to rotate more rapidly that its drive unit.

The device may include a yarn guide tube extending from a feed-in-point to the bottom end of the member and the tube may have an inside diameter of 1 mm to 5 mm.

The member may be constituted by a bell, which may be shaped to match the yarn bodies. The bells have a cylindrical top part and a conical bottom part. The bell may be mounted on air bearings. The tube may be firmly connected to the inside of the bell and an identical balance compensating tube may be provided.

The advantage of at least some embodiments of the device according to the invention arise from the fact that the inlet for passing the yarn into the twist providing member enclosing the spindle is relatively close to the drawing frame which delivers the yarn, so that the yarn is given a twist only over a relatively short distance. No balloon can form, and there is only a minimal braking action. Furthermore, the member for providing the twist is mounted in a special support element by means of a bearing, so that it can be made to rotate independently of the spindle.

The invention may be performed in a number of ways, specific embodiments of which will now be described, by way of example, with reference to the accompanying drawings, in which.

Figure 1:
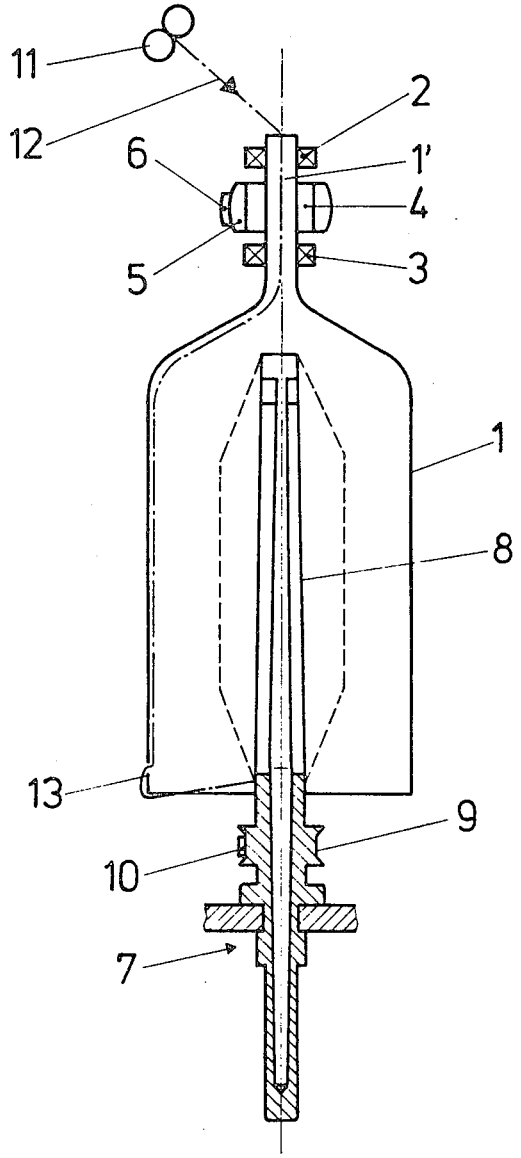
FIG. 1 shows a first specific embodiment of the device of the invention in longitudinal section.
Figure 6:
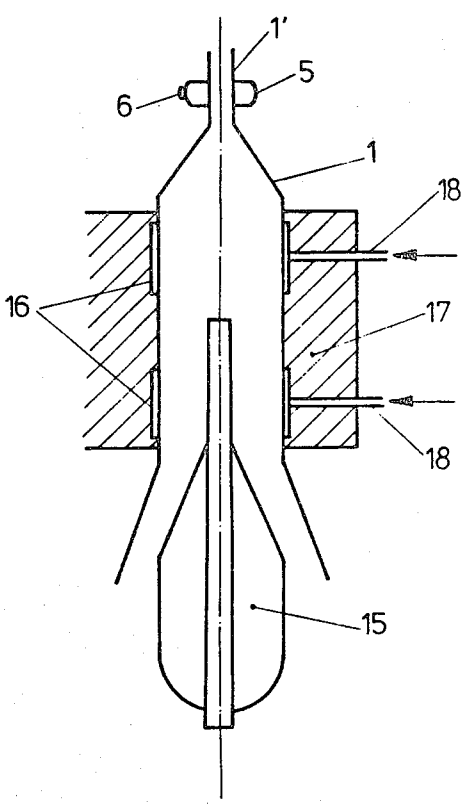
Figure 7:
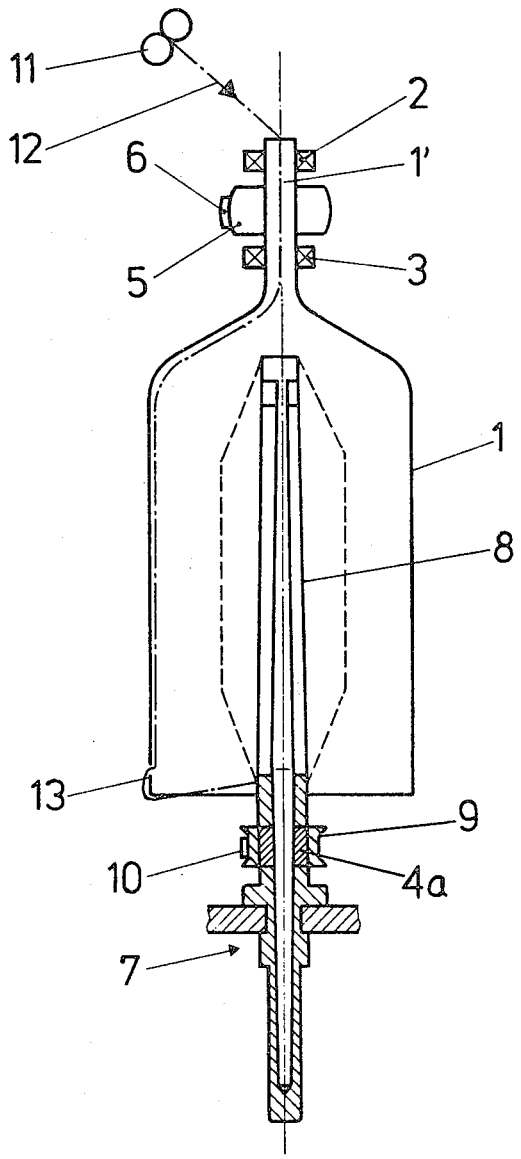

FIGS. 3 to 6 each show in central longitudinal section shapes of bells which are matched to various yarn bodies; and FIG. 7 shows in longitudinal section a modification of the embodiment of FIG. 1.

In FIG. 1, the member for providing the twist has the shape of a bell 1, whose upper part is generally conical. Adjoining this is a tubular extension 1', which is mounted on a stationary support (not shown) by two ball bearings, 2 and 3. The tubular extension 1' carries a whorl 5, between the bearings 2, 3, which is provided with a built-in freewheel 4 and is driven by means of a belt 6. A spindle 7 is located inside the bell 1. The spindle 7 has a winding sleeve 8, which is provided with a whorl 9 and is driven by means of the belt 10.

The yarn 12 is delivered by the pair of delivery rolls 11 of the drawing frame and passes through the tubular extension 1' into the actual bell 1, where it is led through an aperture 13 in the edge of the bell and wound onto the winding sleeve 8.

As the yarn feed-in rate is constant, whilst the diameter of the yarn body is not, different values are produced for the number of revolutions of the bell. The following relationship applies:

$$V_G = V_A - (L/\pi d) + k)$$

$V_G$=speed of rotation of the cap $V_A$=driving speed of the spindle

L=speed of delivery of the yarn d=diameter of yarn body

K=a constant which is dependent upon the yarn diameter, its strength and coefficient of friction.

Assuming that $V_A$ is 25,000 revs/min. and L=40 m/min., the following values for $V_G$ are produced for a minimal yarn body diameter $d_1$=25 and a maximal yarn body diameter of $d_2$=50 mm:

for $d_1$: $L/\pi d_1 = 510$; $^VG_1 = 25{,}000 - 510 = 24{,}490$ for $d_2$: $L/\pi d_2 = 255$; $^VG_2 = 25{,}000 - 255 = 24{,}745$ The bell is advantageously driven at a constant speed of about 24,000–24,300 revs/min. and reaches the necessary number of revolutions $^VG_1$ and $^VG_2$ by means of yarn tension with the aid of the freewheel 4.

The bell enclosing the spindle can also have other shapes, e.g. it can be wing-shaped instead of being bell-shaped.

As can be seen in FIG. 7, in an alternative arrangement a freewheel 4a is provided on the spindle, instead of the freewheel 4 incorporated in the drive whorl 5.

Figure 2:
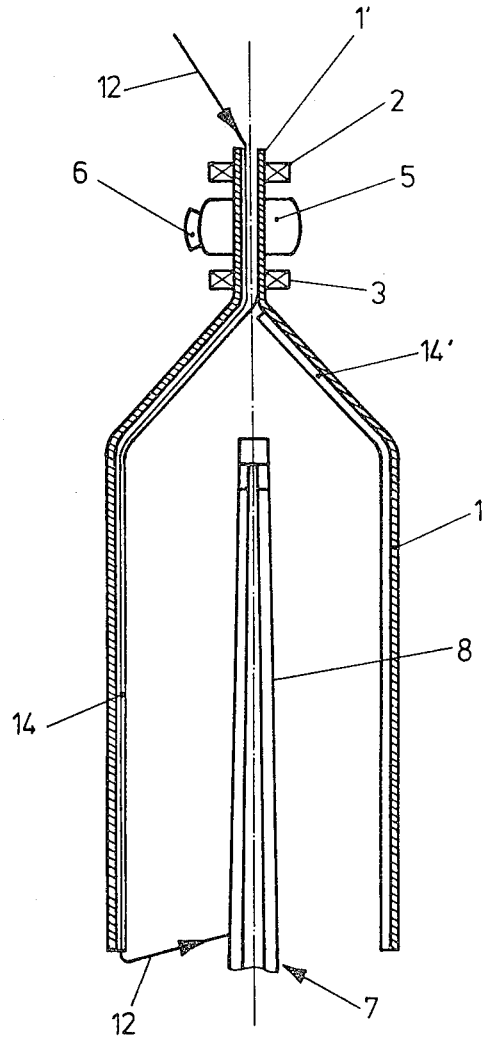
FIG. 2 shows a second specific embodiment in longitudinal section.

FIG. 2 shows a central longitudinal section through a bell-shaped member 1, which encloses the shaft of the spindle 7. A metal yarn guide tube 14 is firmly connected to the inside of the bell 1 and extends from the tubular extension 1' to the bottom edge of the bell. The tube 14 has an inside diameter of 3 mm. An identical metal tube 14' is fixed diametrically opposite the metal tube 14, on the inside wall of the bell. The purpose of the tube 14 is merely to compensate imbalance and it is not connected to the aperture in the extension 1'.

The yarn 12 which is delivered by the unillustrated drawing frame first passes through the aperture in the tubular extension 1', then runs through the tube 14 and is led to the winding sleeve 8. The tube 14 and 14' may, alternatively be made from plastics material.

Figure 3:
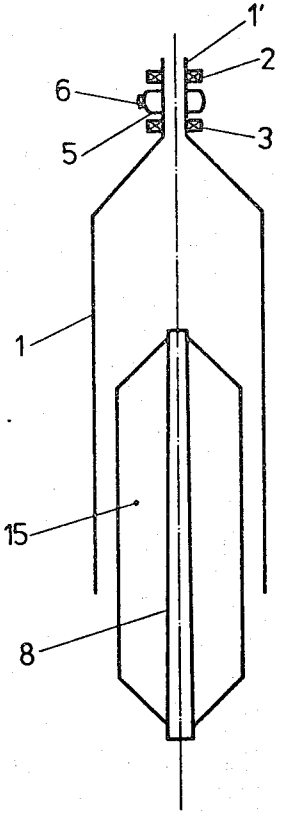

FIG. 3 shows a cylindrical bell 1, which encloses the shaft of the spindle 7 with the winding sleeve 8 and the yarn body 15. The inside diameter of the cap 1 is matched to the maximal diameter of the yarn body 15, which has a parallel winding.

Figure 4:
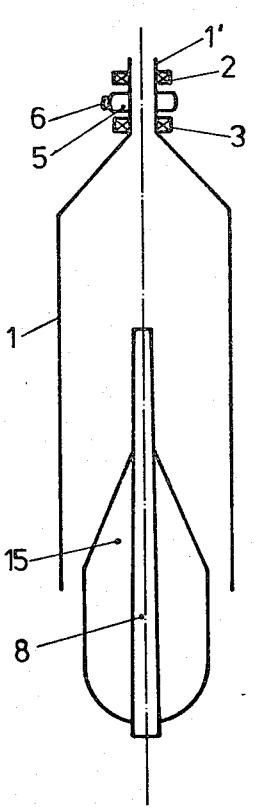

FIG. 4 shows a bell which is designed in the same way as in FIG. 3, but the yarn body 15 has a cop winding.

Figure 5:
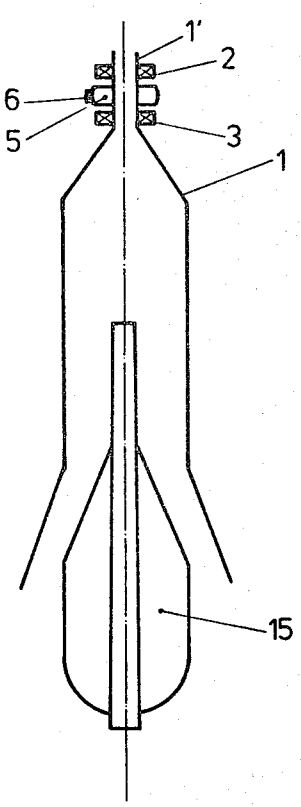

FIG. 5 shows a bell 1, which has a generally cylindrical top part and a generally conical bottom part. Thus, the shape of this bell is matched as far as possible to the spool body 15, which has a cop winding. The tubular extension 1' of the bell 1 is similarly mounted in two ball bearings 2 and 3.

FIG. 6 shows a bell which is designed in the same way as in FIG. 5, but the cylindrical part of this bell 1 is mounted on a stationary support 17 by means of air bearings 16.

Air or another suitable gas is fed under pressure through inlet 8 into the bearings 16 by pressure.

The advantage of the specific embodiments shown in FIGS. 3 to 6 arises from the fact that it is possible to provide bells with a minimal diameter and an aerodynamically advantageous shape which require considerably less driving energy than bells with a large diameter. The driving energy can be even further reduced by mounting the bell in the air bearings.

I claim:

1. In a device for continuous spinning of textile yarn including a spindle, a member for providing twist in the yarn, said member defining a yarn guiding opening for guiding the yarn moving towards the spindle, means for mounting said member for rotation about the spindle axis independently of the spindle, spindle drive means for rotating the spindle, and drive means for rotating said member, the improvement comprising a freewheel arranged between said member and said drive means for rotating the member, for allowing the member to rotate more rapidly than the member drive means.

2. In a device for continuous spinning of textile yarn including a spindle, a member for providing twist in the yarn, said member including a yarn guiding opening for guiding the yarn towards the spindle, means for mounting said member for rotation about the spindle axis independently of the spindle, spindle drive means for rotating the spindle, and drive means for rotating said member, the improvement comprising a freewheel arranged between said spindle and said spindle drive means, for allowing the spindle to rotate more rapidly than the spindle drive means.

3. A device as claimed in claim 1 wherein the member defines a yarn feed-in point and further including a yarn guide tube on the member extending from the feed in point to the yarn guiding outlet, the tube having an inside diameter of 1 to 5 mm.

4. A device as claimed in claim 3, wherein the tube extends along the inside wall of the bell and is firmly secured thereto.

5. A device as claimed in claim 4, further including a further tube, identical to the first mentioned tube, mounted on the inside wall of the member diametrically opposite the first mentioned tube to compensate for imbalance.

6. A device as claimed in claim 1 further including a yarn body carried by the spindle and wherein the member is in the form of a bell and has a shape which is generally matched to the shape of the yarn body on the spindle.

7. A device as claimed in claim 6, wherein the bell as a generally cylindrical top part and a generally conical bottom part.

8. A device as claimed in claim 6, wherein the means for mounting the bell is an air bearing.

9. A device as claimed in claim 2 wherein the member defines a yarn feed-in point and further including a yarn guide tube on the member extending from the feed in point to the yarn guiding outlet, the tube having an inside diameter of 1 to 5 mm.

10. A device as claimed in claim 2 further including a yarn body carried by the spindle and wherein the member is in the form of a bell and has a shape which is generally matched to the shape of the yarn body on the spindle.

* * * * *